United States Patent [19]

Sargent

[11] 4,407,455

[45] Oct. 4, 1983

[54] SNAP-IN ROTATABLE SPRINKLER

[75] Inventor: Ronald J. Sargent, Los Angeles, Calif.

[73] Assignee: RIS Irrigation Systems, El Cajon, Calif.

[21] Appl. No.: 369,033

[22] Filed: Apr. 16, 1982

[51] Int. Cl.[3] ..... B05B 3/04

[52] U.S. Cl. ..... 239/222.17; 239/261

[58] Field of Search ..... 239/251, 276, 222.17, 239/261, 382, 600, 259, 264

[56] References Cited

U.S. PATENT DOCUMENTS

| | | | |
|---|---|---|---|
| 912,493 | 2/1909 | Sanders | 239/261 |
| 1,467,601 | 9/1923 | Chambers | 239/222.17 |
| 1,760,375 | 5/1930 | Ryerson | 239/222.17 |
| 4,219,161 | 8/1980 | Freissle | 239/600 X |

*Primary Examiner*—John J. Love
*Assistant Examiner*—Mary F. McCarthy
*Attorney, Agent, or Firm*—Gordon L. Peterson

[57] ABSTRACT

A rotatable sprinkler comprising a plastic body having a passage extending through the body and a shoulder within the passage. The body is connectable to a source of water under pressure. A plastic sprinkler head is rotatably received within the passage and is unsupported externally of the housing. The sprinkler head has a retainer integral with the sprinkler head which forms a snap fit with the shoulder to retain the sprinkler head within the passage of the body. A restricted orifice in the passage of the body directs water at relatively high velocity into and through a passage in the sprinkler head. The passage in the sprinkler head is configured so that the sprinkler head is rotated by the flow of water through the sprinkler head.

6 Claims, 4 Drawing Figures

SNAP-IN ROTATABLE SPRINKLER

BACKGROUND OF THE INVENTION

One known type of plastic sprinkler includes a body and a rotatable sprinkler head which is rotated by the reaction force of water passing through the sprinkler head. In this form of sprinkler, at least one support arm projects upwardly from the body to provide a bearing above the sprinkler head, and the sprinkler head is rotatably mounted by the bearing and by another bearing within the body. Thus, the rotatable sprinkler head is rotatably mounted by the body and by the bearing which is external to the body.

As the sprinkler head rotates, it discharges water in a generally circular pattern. However, the support arm provides an obstruction in the circular pattern and interrupts the circular pattern. Accordingly, water is discharged in a generally circular segment which extends for less than 360 degrees. As a consequence, less than the full area which it is desired to irrigate receives water, and an excessive amount of irrigation water may drip from the support arm to a region adjacent the sprinkler.

SUMMARY OF THE INVENTION

This invention eliminates the support arm used heretofore to provide a bearing for the rotatable sprinkler head external to the body. Accordingly, the sprinkler of this invention discharges water in a circular pattern, and the sprinkler provides an obstruction-free path to the circular pattern so that the pattern is not interrupted. As a result, the desired area is irrigated.

This desirable result may be obtained simply and inexpensively by utilizing inexpensive plastic components. Preferably, the sprinkler head is snap fit within the body of the sprinkler to retain the sprinkler head on the body but to allow free rotation of the sprinkler head relative to the body. With this construction, the sprinkler head is unsupported externally of the body, and no obstruction to the circular pattern of water discharged from the sprinkler head is provided.

In a preferred construction, the rotatable sprinkler includes a body having a passage extending therethrough and a shoulder in the passage. The body is connectable to a source of water under pressure so that water can flow through the passage. One portion of a sprinkler head is rotatably received within the passage to mount the sprinkler head for rotation relative to the housing, and another portion of the sprinkler head projects from the body. A retainer is provided on the portion of the sprinkler head that is within the body and is engageable with the shoulder to retain the sprinkler head against withdrawal from the passage in at least one direction without preventing rotation of the sprinkler head relative to the housing. The sprinkler head has passage means extending therethrough, and a restricted orifice is provided in the passage of the body. The passage means in the sprinkler head is configured so that the sprinkler head is rotated by the reaction of the water passing through it.

The invention, together with additional features and advantages thereof, may best be understood by reference to the following description taken in connection with the accompanying illustrative drawing.

DESCRIPTION OF THE PREFERRED EMBODIMENT

Figure 1:
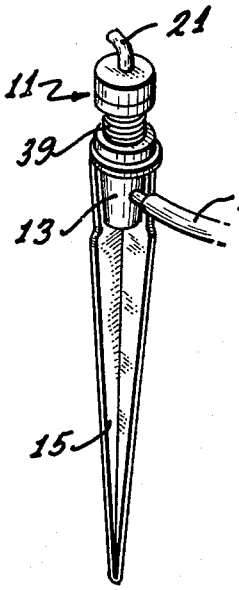
FIG. 1 is a perspective view of one form of sprinkler constructed in accordance with the teachings of this invention and coupled to a water supply and mounting means for the sprinkler.
Figure 2:
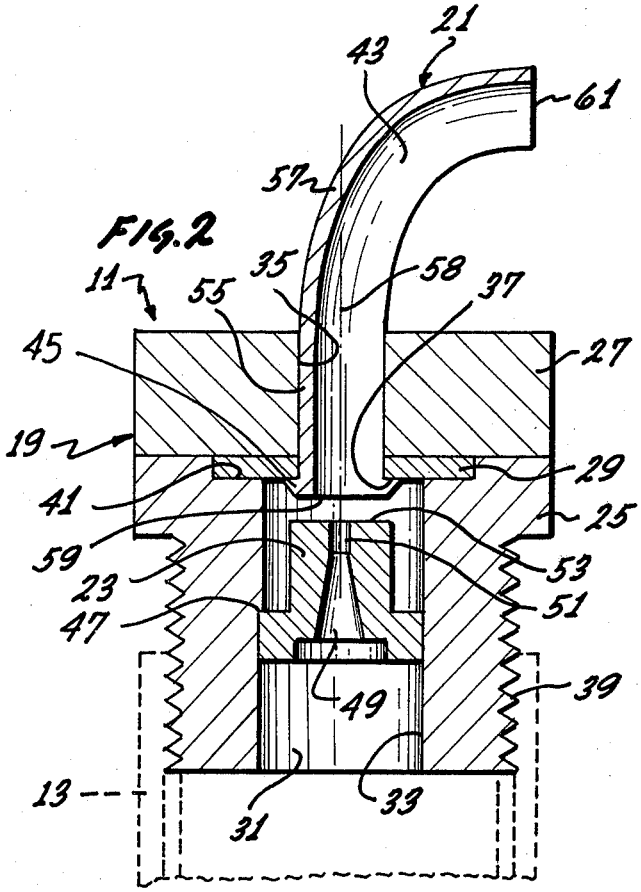
FIG. 2 is an enlarged sectional view taken in an axial plane through the sprinkler head and body, with other portions of the sprinkler being shown in dashed lines.
Figure 4:
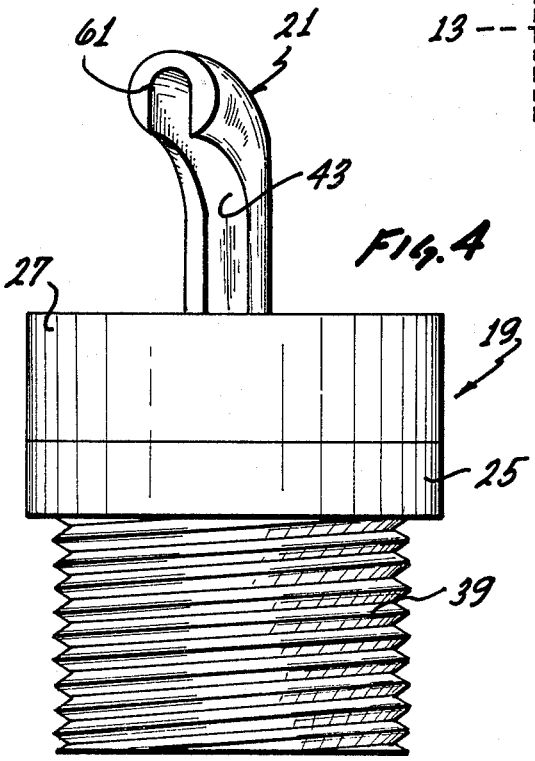
FIG. 4 is a side elevational view of the sprinkler.
Figure 3:
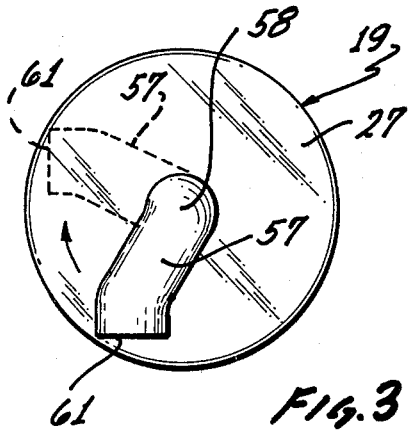
FIG. 3 is a top plan view of the sprinkler.

FIGS. 2–4 illustrate a rotatable sprinkler 11 which is adapted to be connected to appropriate mounting means, such as a standpipe or socket 13. Although various different constructions are possible, in the embodiment illustrated in FIG. 1, the socket 13 is constructed of plastic material and is formed integrally with a mounting stake 15 which can be pushed into the ground to mount the sprinkler 11. Water under pressure is supplied to the socket 13 by a flexible tube 17 which, in turn, may receive water from a header (not shown).

The sprinkler 11 includes a body 19, a rotatable sprinkler head 21 and a restrictor or jet 23. Although the body 19 may be formed as a single piece, in the embodiment illustrated, it includes a lower body section 25, an upper body section 27 and a bearing plate 29, all of which are preferably constructed of a plastic material, such as ABS or polypropylene. The body sections 25 and 27 and the bearing plate 29 are suitably affixed to each other as by a suitable adhesive.

The body 19 has an axial passage 31 extending completely through the body. The passage 31 includes cylindrical passage sections 33 and 35 of different diameters forming a smooth shoulder 37 at the juncture of the two passage sections.

As shown in FIG. 2, the bearing plate 29 is in the form of a flat washer or apertured disc. The shoulder 37 is defined by an inner annular region of the lower face of the bearing plate.

The body 19 has external screw threads 39 on the lower body section 25 to permit the sprinkler 11 to be threadedly attached to the socket 13. The lower body section 25 has a cylindrical recess 41 at its upper end for receiving the bearing plate 29.

The upper housing section 27 in the embodiment illustrated is in the form of a relatively thick washer which overlies the upper end of the lower body section 25 to capture the bearing plate 29 in the recess 41. In the embodiment illustrated, the passage section 33 is defined by the lower body section 25, and the passage section 35 is defined by the upper body section 27 and the bearing plate 29.

The sprinkler head 21 has passage means in the form of a channel 43 which extends completely through the sprinkler head from one end to the other. Although many different constructions are possible, in the form illustrated, the sprinkler head 21 is in the form of a rod of generally circular radial cross section having the channel 43 formed therein. The channel 43 is configured so that flow of water through the channel causes the sprinkler head 21 to rotate as a reaction turbine. The sprinkler head 21 is integrally formed from a suitable plastic material and has an annular enlargement or retainer 45 formed integrally with its inner end.

The jet 23 is coaxially mounted within the passage section 33 and is suitably retained against a small shoulder 47. The jet 23, which may be constructed of a suitable plastic material, has an axial passage 49 of reducing cross-sectional area which terminates in a restricted orifice 51 at an upper face 53. The face 53 is spaced from the shoulder 37 a distance greater than the axial thickness of the retainer 45, and the retainer 45 lies intermediate the face 53 and the shoulder 37.

The sprinkler head 21 has one portion 55 which is rotatably received in the passage 31 and a second portion 57 which projects from the body 19. The portion 55, except for the retainer 45, is cylindrical and constitutes, in effect, a shaft rotatably mounted in the passage section 35, and the latter constitutes, in effect, a bearing for the shaft. This mounts the sprinkler head 21 for rotation about an axis 58 which is coaxial with the passage 31.

The channel 43 has an inlet 59 which confronts and is coaxial with, the orifice 51 and an outlet 61. The portion 57 is curved in axial cross section so that water passing through the channel 43 will be discharged radially of the sprinkler 11. In addition, the portion 57 is offset in top plan to displace the axis of the outlet 61 from the rotational axis 58 of the sprinkler head as shown in FIG. 3.

To assemble the sprinkler head 21 and the body 19, the retainer 45 is forced through the passage section 35 to the position shown in FIG. 2 in which the retainer is captured between the shoulder 37 and the face 53 of the jet 23. This snap-fit formed by the retainer 45 and the shoulder 37 facilitates guick assembly and disassembly of the sprinkler 11 thereby facilitating manufacture and cleaning.

In use of the sprinkler 11, water under pressure is supplied from the tube 17 through the socket 13 to the passage section 33. Water flowing through the passage 49 is accelerated by the relatively small cross section of the passage 49 and particularly of the orifice 51. Accordingly, a high velocity jet of water emanates from the orifice 51 and passes through the channel 43 from the inlet 59 to the outlet 61. The water discharging from the outlet 61 rotates the sprinkler head 21 in the direction shown by the arrow in FIG. 3 to discharge the water in a generally circular pattern. The sprinkler head 21 is unsupported externally of the housing, and the sprinkler provides an obstruction-free path to the circular pattern so that this circular pattern is not interrupted.

The force of the water from the orifice 51 impinging on the sprinkler head 21 elevates the sprinkler head to the position shown in FIG. 2 in which the retainer 45 engages the shoulder 37. The retainer 45 and the shoulder 37 serve as a thrust bearing for the sprinkler head, and the surface of the passage section 35 forms a bearing which rotatably mounts the sprinkler head. Preferably, the bearing plate 29 and the retainer 45 are constructed of dissimilar materials to provide better bearing wear and all bearing surfaces which are subject to sliding contact are smooth.

Although an exemplary embodiment of the invention has been shown and described, many changes, modifications and substitutions may be made by one having ordinary skill in the art without necessarily departing from the spirit and scope of this invention.

I claim:

1. A rotatable sprinkler comprising:

a body having a passage extending therethrough and a shoulder in said passage, said body being connectable to a source of water under pressure;

a sprinkler head of plastic material, one portion of said sprinkler head being rotatably received in said passage to mount the sprinkler head for rotation relative to said body and another portion of the sprinkler head projecting from the body;

said one portion of said sprinkler head having a retainer thereon engageable with said shoulder and forming a snap-fit therewith to retain said one portion of the sprinkler head against withdrawal from the passage in at least one direction without preventing rotation of the sprinkler head relative to said body;

said sprinkler head having passage means extending therethrough communicating with the passage in said body;

means defining a restricted orifice in said passage in said housing for directing water at relatively high velocity into and through said passage means of said sprinkler head;

said passage means being configured so that the sprinkler head is rotated relative to said body by the flow of water in the passage means of the sprinkler head; and said passage means of said sprinkler head discharges the water flowing through the passage means in a generally circular pattern and said sprinkler provides an obstruction-free path to said circular pattern whereby the circular pattern is not interrupted by the sprinkler.

2. A rotatable sprinkler as defined in claim 1 wherein said body is constructed of a plastic material.

3. A rotatable sprinkler as defined in claim 2 wherein said retainer is integral with said one portion of said sprinkler head.

4. A rotatable sprinkler as defined in claim 1 wherein said sprinkler head is unsupported externally of said passage in said body.

5. A rotatable sprinkler as defined in claim 4 wherein said body is constructed of plastic and said retainer is integral with said one portion of said sprinkler head.

6. A rotatable sprinkler as defined in claim 1 wherein the retainer is retained between said shoulder and said restricted orifice means and said passage means includes a curved channel.

* * * * *